United States Patent [19]

Allers et al.

[11] Patent Number: 4,690,335

[45] Date of Patent: Sep. 1, 1987

[54] METHODS AND APPARATUS FOR TWO-STAGE CRUSHING

[75] Inventors: Tyark Allers, Sendenhorst; Gotthardt Blasczyk, Beckum, both of Fed. Rep. of Germany

[73] Assignee: Krupp Polysius AG, Bekum, Fed. Rep. of Germany

[21] Appl. No.: 837,946

[22] Filed: Mar. 10, 1986

[30] Foreign Application Priority Data

Jun. 4, 1985 [DE] Fed. Rep. of Germany ..... 3520069

[51] Int. Cl.[4] ..... B02C 25/00

[52] U.S. Cl. ..... 241/24; 241/29; 241/34; 241/80; 241/152 A

[58] Field of Search ..... 241/29, 152 A, 24, 79, 241/80, 97, 34, 26, 284, 135

[56] References Cited

U.S. PATENT DOCUMENTS

| | | | |
|---|---|---|---|
| 1,723,726 | 8/1929 | Doyle | 241/80 X |
| 3,145,935 | 8/1964 | Wilson | 241/97 X |
| 3,630,457 | 12/1971 | Forman et al. | 241/34 |
| 4,053,113 | 10/1977 | Rosenstock et al. | 241/34 X |
| 4,592,512 | 6/1986 | Grigel et al. | 241/29 X |

FOREIGN PATENT DOCUMENTS

| | | | |
|---|---|---|---|
| 482748 | 9/1929 | Fed. Rep. of Germany | 241/29 |
| 1131974 | 6/1962 | Fed. Rep. of Germany | 241/34 |
| 1163908 | 6/1985 | U.S.S.R. | 241/34 |

OTHER PUBLICATIONS

European Patent Application, 0084383, 4–1983.

*Primary Examiner*—Mark Rosenbaum
*Attorney, Agent, or Firm*—Learman & McCulloch

[57] ABSTRACT

A method and apparatus for two-stage crushing of material wherein the material is subjected to crushing first in a constant speed roll mill and then in a second mill. Grit resulting from the crushing is returned to the first mill in a proportion to maintain the filling level of combined fresh material and grit substantially constant even when the quantity of such fresh material changes.

4 Claims, 1 Drawing Figure

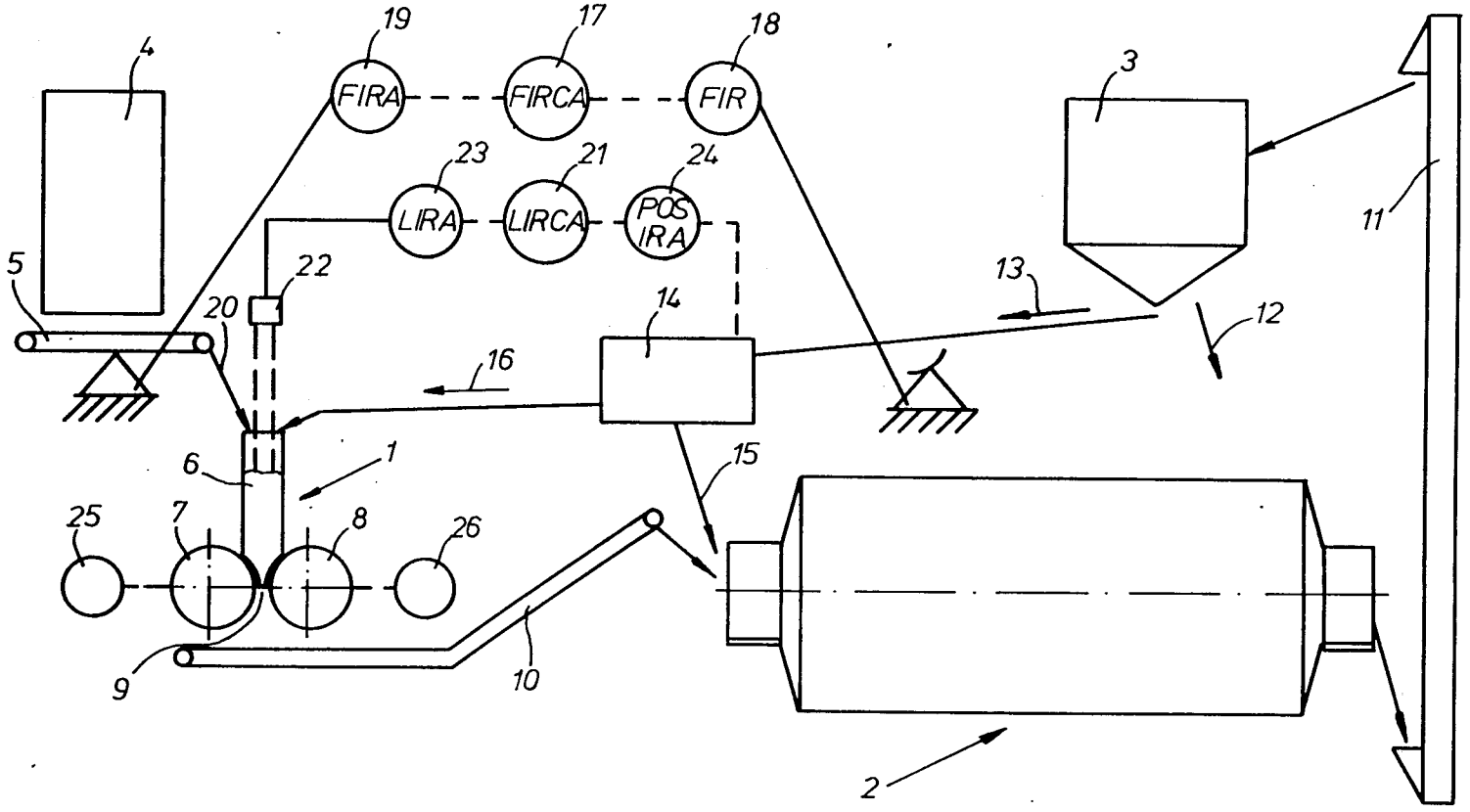
FIR
POS IRA
FIRCA
LIRCA
LIRA
FIRA

METHODS AND APPARATUS FOR TWO-STAGE CRUSHING

The invention relates to a method and apparatus for crushing brittle material such as cement clinker.

BACKGROUND OF THE MATERIAL

A method of the general class to which the invention relates is described in European Patent application No. 0084383.

In known two-stage grinding methods the quantity of grit recirculated in the grinding system fluctuates somewhat as a function of the grindability of the material. In order to maintain optimum crushing conditions in the second mill, which for example may be a ball mill, it is known for the quantity of fresh material to be regulated as a function of the quantity of recirculated grit so that the sum of the quantity of fresh material and the quantity of grit, and thus the degree of filling of the second mill, remains constant.

If the speed of a roll mill were to be maintained constant, alteration of the quantity of fresh material supplied therto would result in a change in the material filling level in the delivery chute of the roll mill. This would entail an alteration in the grinding conditions in the roll mill and in, certain circumstances, would lead to the delivery chute running full or running empty.

In order to avoid this disadvantage it is known to vary the speed of the roll mill to be altered appropriately when the quantity of fresh material is altered (i.e., adapted to the quantity of grit at that time) in order in this way to achieve a constant filling level in the delivery chute of the roll mill. However, such a method requires the use of comparatively expensive variable-speed drives for the two rolls of the roll mill.

The object of the invention, therefore, is to provide comparatively low expense apparatus and a method which ensure optimum crushing conditions.

SUMMARY OF THE INVENTION

According to the invention the rolls of the initial stage roll mill are driven at a constant speed. This means that simple unregulated drives can be used, which makes possible a considerable reduction in the cost of the apparatus.

Nevertheless, in order to achieve constant crushing conditions, not only in the subsequent or second mill but also in the roll mill, even with an alteration in the grindability and a resulting alteration in the quantity of grit and a correspondingly altered quantity of fresh material, according to the invention just the right proportion of the grit is delivered to the roll mill so that even with a changing quantity of fresh material a constant filling level is maintained in the delivery chute of the roll mill.

If for example in the event of reduced grindability of the material the quantity of grit is increased and as a consequence (in order to achieve a constant degree of filling in the subsequent mill) the quantity of fresh material is reduced, then according to the invention an increased proportion of the grit is delivered to the roll mill so that the constant filling level in the delivery chute of this mill ensures constant intake conditions and thus optimum crushing conditions.

Using the method according to the invention, therefore, it is possible to produce several kinds of cement of differing fineness by means the same grinding apparatus, with optimum utilisation of the apparatus and a low specific energy consumption. Thus, during grinding of cement with a high degree of fineness and with a correspondingly reduced quantity of fresh material the proportion of the quantity of fresh material lacking in the roll mill is replaced by an increased proportion of returned grit. In this way a certain part of the crushing work is transferred from the subsequent mill to the roll mill, and both of the mills in the grinding system can operate under optimum crushing conditions.

THE DRAWING

One embodiment of apparatus for carrying out the method according to the invention is illustrated schematically in the FIGURE of the accompanying drawing.

DETAILED DESCRIPTION

The apparatus comprises a first or initial roll mill 1, a subsequent or second mill 2, which is constructed for example as a ball mill, and a sifter 3.

Fresh material to be ground is taken from a storage bin 4 via a dosaging conveyor-type weigher 5 and passed to the delivery or charging chute 6 of the roll mill 1 which has two driven rolls 7, 8 having a roll gap 9 between them. Preferably one of the rolls is fixed and the other is adjustable to vary the width of the gap.

The material which is crushed in the roll mill 1 passes via a conveyor 10 to the second mill 2 where the agglomerates formed in the roll mill 1 are broken up and if necessary crushed further.

The material discharged from the mill 2 is delivered by a bucket conveyor 11 to the sifter 3 from which finished material (arrow 12) is separated from grit (arrow 13).

The grit passes to a distributor 14 from which some is recirculated to the delivery end of the mill 2 (arrow 15) and some (arrow 16) to the delivery chute 6 of the roll mill 1.

A first control circuit serves to keep the sum of the quantities of fresh material and grit constant during fluctuations in the grindability. This control circuit includes a known regulator 17 which receives a signal corresponding to the quantity of grit at that time via a known element 18 and acts via a known element 19 to vary the speed of the dosaging conveyor-type weigher 5. In this way the quantity of fresh material is reduced when the quantity of grit increases, and vice versa.

A second control circuit serves to keep the filling level in the delivery chute 6 of the roll mill 1 constant irrespective of fluctuations in the quantity of fresh material. This control circuit includes a known regulator 21 which receives a signal corresponding to the filling level at the time in the delivery chute 6 via a known filling level measuring device 22 (which functions for example on the basis of ultrasound) and a known element 23 and supplies a corresponding control signal via a known element 24 to the distributor 14.

If the grindability of the material is reduced or if an end product of greater fineness is required, the quantity of grit increases. The quantity of fresh material (arrow 20) is correspondingly reduced by the regulator 17. In order nevertheless to keep the filling level in the delivery chute 6 constant, the regulator 21 acts in this case via the distributor 14 to increase the proportion of grit returned to the delivery chute 6 (arrow 16).

If the grindability of the material is improved or if an end product is required with coarser grains, the controls operate in the reverse manner to decrease the proportion of grit recirculated in the system. The two rolls 7 and 8 of the roll mill 1 are driven at a constant speed by unregulated, simple drive motor 25, The letters displayed on the regulators 17, 21 and in the further elements 18, 19, 23, and 24 of the two control circuits have the following meanings:

F=quantity
I=display
R=recording
C=control
A=alarm
L=filling level
POS=position

The grain size of at least a proportion of the fresh material is advantageously greater than the width of the roll gap 9 so that in the roll gap 9 this proportion of the material first undergoes individual grain crushing and then material bed crushing. The pressure of the rolls 7 and 8 exerted on the material amounts to more than 2 t/cm of roll length.

While in the disclosed embodiment the rolls 7, 8 are driven, it is also possible within the scope of the invention for only one of these rolls, preferably the fixed roll, to be driven.

What is claimed is:

1. In a two-stage method of crushing brittle material wherein fresh material is delivered via a filling chute to a first roll mill having a pair of spaced apart rotary rolls, agglomerates from the roll mill are passed to a second mill, the discharge of said second mill is sifted to separate finished material and grit, and grit is returned to at least one of said mills for further crushing, the improvement comprising rotating the rolls of said roll mill at a substantially constant speed, adjusting the quantity of fresh material delivered to said filling chute in generally inverse relationship to the total quantity of returned grit to keep the sum of the quantities of fresh material and grit being processed constant during fluctuations in grindability of said fresh material, delivering to said first roll mill a quantity of said returned grit sufficient to maintain a substantially constant level of grit and fresh material in said filling chute irrespective of fluctuations in the adjusted quantity of fresh material supplied, and delivering the remaining quantity of said returned grit directly to said second mill.

2. The method according to claim 1 including introducing fresh material of such grain size to said roll mill that at least a proportion of said fresh material first undergoes individual grain crushing and then material bed crushing in said roll mill.

3. In two-stage apparatus for crushing brittle material having a first roll mill including a pair of rotary rolls spaced apart by a gap, delivery means for supplying fresh material to said first roll mill, a second mill downstream from said first mill for receiving agglomerates therefrom and subjecting such agglomerates to further crushing, sifting means for separating grit from finished material, and means for delivering crushed material to said sifting means, the improvement comprising means for returning grit from said sifting means to each of said mills, means for driving the rolls of said roll mill at a substantially constant speed, signal means responsive to the total quantity of grit separated by said sifting means, first regulator means controlled by said signal means for adjusting the quantity of fresh material supplied to said first mill in generally inverse relationship to the total quantity of grit for keeping the sum of the quantities of fresh material and grit being processed constant during fluctuations in grindability of said fresh material, means for measuring the quantity of fresh material being delivered to said first mill, and second regulator means responsive to said measuring means for determining the portion of grit returned to said first mill to maintain a substantially constant desired level of grit and fresh material delivered thereto irrespective of fluctuations in the adjusted quantity of fresh material supplied, and means for diverting the remaining portion of the grit directly to said second mill.

4. Apparatus according to claim 3 wherein the spacing between the rolls of said roll mill forms a gap between said rolls of such width relative to the grain size of said fresh material that at least a portion of said fresh material is subjected in said roll mill first to grain crushing and then to material bed crushing.

* * * * *

UNITED STATES PATENT AND TRADEMARK OFFICE

CERTIFICATE OF CORRECTION

PATENT NO. : 4,690,335

DATED : September 1, 1987

INVENTOR(S) : Tyark Allers et al

It is certified that error appears in the above-identified patent and that said Letters Patent are hereby corrected as shown below:

Column 1, line 24, change "therto" to -- thereto -- .

Column 3, line 3, insert -- 26. -- after "25," .

Signed and Sealed this

Twelfth Day of January, 1988

*Attest:*

*Attesting Officer*

DONALD J. QUIGG

*Commissioner of Patents and Trademarks*